US011231045B2

(12) United States Patent
Takemoto et al.

(10) Patent No.: US 11,231,045 B2
(45) Date of Patent: Jan. 25, 2022

(54) IMPELLER AND AXIAL FAN

(71) Applicant: Nidec Corporation, Kyoto (JP)

(72) Inventors: Hideyuki Takemoto, Kyoto (JP); Kazuhiro Inouchi, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 0 days.

(21) Appl. No.: 17/065,574

(22) Filed: Oct. 8, 2020

(65) Prior Publication Data

US 2021/0108651 A1 Apr. 15, 2021

(30) Foreign Application Priority Data

Oct. 9, 2019 (JP) ..... JP2019-185827

(51) Int. Cl.
*F04D 29/66* (2006.01)
*F04D 29/38* (2006.01)

(52) U.S. Cl.
CPC ..... *F04D 29/38* (2013.01); *F04D 29/666* (2013.01); *F05D 2250/38* (2013.01); *F05D 2260/96* (2013.01)

(58) Field of Classification Search
CPC ..... F04D 29/38; F04D 29/666; F04D 29/328; F04D 29/281; F05D 2250/38
See application file for complete search history.

(56) References Cited

U.S. PATENT DOCUMENTS 4,253,800 A * 3/1981 Segawa ..... F01D 5/10 415/119
4,358,245 A * 11/1982 Gray ..... F01P 7/06 123/41.49
4,840,541 A * 6/1989 Sakane ..... F04D 29/384 415/119
5,000,660 A * 3/1991 Houten ..... F04D 29/328 415/119
5,681,145 A * 10/1997 Neely ..... F04D 29/328 415/119
6,139,275 A 10/2000 Noda et al.
6,488,472 B1 * 12/2002 Miyazawa ..... F04D 29/282 416/144
6,491,499 B1 * 12/2002 Marvin ..... F04D 29/328 415/119
7,651,316 B2 * 1/2010 Kruger ..... F04D 29/666 415/119

(Continued)

FOREIGN PATENT DOCUMENTS

JP 2000-045992 A 2/2000
JP 3148914 U 3/2009
JP 5001975 B2 8/2012

*Primary Examiner* — Woody A Lee, Jr.
*Assistant Examiner* — Brian Christopher Delrue
(74) *Attorney, Agent, or Firm* — Keating & Bennett

(57) ABSTRACT

An impeller includes Z blades, where Z is an integer equal to 5 or more, arranged in a circumferential direction of the impeller and extending radially, pitch angles between adjacent blades being all different. In terms of an arbitrary pitch angle θ, when a pitch angle α1 adjacent to the pitch angle θ, and a pitch angle α2 adjacent to the pitch angle θ, different from the pitch angle α1, satisfy a relation, α1<α2, a pitch angle β1 different from the pitch angle θ adjacent to the pitch angle α1 and a pitch angle β2 adjacent to the pitch angle β2, different from the pitch angle θ, satisfy a relation, β2<β1.

4 Claims, 11 Drawing Sheets

(56) References Cited

U.S. PATENT DOCUMENTS

| | | | | |
|---|---|---|---|---|
| 10,480,527 | B2 * | 11/2019 | Van Houten | F04D 19/002 |
| 10,519,979 | B2 * | 12/2019 | Lin | F04D 29/281 |
| 2002/0182053 | A1 * | 12/2002 | Miyazawa | F04D 29/328 415/77 |
| 2003/0108427 | A1 * | 6/2003 | Chow | F04D 29/328 416/203 |
| 2010/0054949 | A1 | 3/2010 | Jang et al. | |
| 2020/0056486 | A1 * | 2/2020 | Schrape | F01D 5/16 |

* cited by examiner

| n | K(n) | SIGN(n) | K(n)・SIGN(n) | %A・K(n)・SIGN(n) | order | Pitch(n) |
|---|---|---|---|---|---|---|
| 1 | −100% | 1 | −100% | −8.33% | 60 | 66 |
| 2 | −50% | −1 | 50% | 4.17% | 24 | 75 |
| 3 | 0% | 1 | 0% | 0 | 5 | 72 |
| 4 | 50% | −1 | −50% | −4.17% | 120 | 69 |
| 5 | 100% | 1 | 100% | 8.33% | 60 | 78 |

| Pitch(n) |
| --- |
| 32.5 |
| 52.5 |
| 85.0 |
| 52.5 |
| 32.5 |
| 52.5 |
| 52.5 |

| Pitch(n) |
| --- |
| 87.4 |
| 27.4 |
| 63.4 |
| 51.4 |
| 39.4 |
| 75.4 |
| 15.4 |

| Pitch(n) |
| --- |
| 70.3 |
| 70.7 |
| 72.0 |
| 64.7 |
| 82.3 |

| Pitch(n) |
| --- |
| 66.0 |
| 75.0 |
| 72.0 |
| 69.0 |
| 78.0 |

| n | K(n) | SIGN(n) | K(n)・SIGN(n) | %A・K(n)・SIGN(n) | order | Pitch(n) |
|---|---|---|---|---|---|---|
| 1 | −100% | 1 | −100% | −50.00% | 18 | 20.0 |
| 2 | −75% | −1 | 75% | 37.50% | 72 | 55.0 |
| 3 | −50% | 1 | −50% | −25.00% | 12 | 30.0 |
| 4 | −25% | −1 | 25% | 12.50% | 8 | 45.0 |
| 5 | 0% | 1 | 0% | 0.00% | 9 | 40.0 |
| 6 | 25% | −1 | −25% | −12.50% | 72 | 35.0 |
| 7 | 50% | 1 | 50% | 25.00% | 36 | 50.0 |
| 8 | 75% | −1 | −75% | −37.50% | 72 | 25.0 |
| 9 | 100% | 1 | 100% | 50.00% | 6 | 60.0 |

Fig. 11

| n | K(n) | SIGN(n) | K(n)・SIGN(n) | %A・K(n)・SIGN(n) | order | Pitch(n) |
|---|---|---|---|---|---|---|
| 1 | −100% | 1 | −100% | −49.00% | 800 | 23.0 |
| 2 | −71% | −1 | 71% | 35.00% | 160 | 60.8 |
| 3 | −43% | 1 | −43% | −21.00% | 800 | 35.6 |
| 4 | −14% | −1 | 14% | 7.00% | 800 | 48.2 |
| 5 | 14% | −1 | −14% | −7.00% | 800 | 41.9 |
| 6 | 43% | 1 | 43% | 21.00% | 800 | 54.5 |
| 7 | 71% | −1 | −71% | −35.00% | 160 | 29.3 |
| 8 | 100% | 1 | 100% | 49.00% | 800 | 67.1 |

Fig. 12

| Pitch(n) |
|---|
| 16.2 |
| 67.5 |
| 42.3 |
| 41.4 |
| 48.6 |
| 47.7 |
| 22.5 |
| 73.8 |

| Pitch(n) |
|---|
| 23.0 |
| 60.8 |
| 35.6 |
| 48.2 |
| 41.9 |
| 54.5 |
| 29.3 |
| 67.1 |

IMPELLER AND AXIAL FAN

CROSS REFERENCE TO RELATED APPLICATION

The present application claims priority under 35 U.S.C. § 119 to Japanese Application No. 2019-185827 filed on Oct. 9, 2019, the entire contents of which are hereby incorporated herein by reference.

1. FIELD OF THE INVENTION

The present disclosure relates to an impeller and an axial fan.

2. BACKGROUND

Impellers each have a plurality of blades disposed about its central axis. Conventionally, a known impeller that reduces noise by forming uneven pitch angles that are each an angle between adjacent blades to disperse a frequency of wind noise generated by rotation of the impeller about its central axis.

Unfortunately, the above-described structure having the uneven pitch angles of the blades may cause centroid balance of the impeller to be lost depending on a method for distributing the pitch angles.

SUMMARY

An impeller according to an example embodiment of the present disclosure includes Z blades disposed in a circumferential direction and extending radially, where Z is an integer equal to 5 or more. Pitch angles between the blades adjacent to each other are all different. In terms of an arbitrary pitch angle θ, when a pitch angle α1 adjacent to the pitch angle θ, and a pitch angle α2 adjacent to the pitch angle θ, different from the pitch angle θ, satisfy a relation, $\alpha 1<\alpha 2$, a pitch angle β1 different from the pitch angle θ adjacent to the pitch angle α1 and a pitch angle β2 adjacent to the pitch angle α2, different from the pitch angle θ, satisfy a relation, $\beta 2<\beta 1$.

The above and other elements, features, steps, characteristics and advantages of the present disclosure will become more apparent from the following detailed description of the example embodiments with reference to the attached drawings.

BRIEF DESCRIPTION OF THE DRAWINGS

FIG. 11 is a diagram showing an example of pitch angle determination results by the exemplary determination method of the present disclosure when the number of blades is nine.

FIG. 12 is a diagram showing an example of pitch angle determination results by the exemplary determination method of the present disclosure when the number of blades is eight.

DETAILED DESCRIPTION

Hereinafter, example embodiments of the present disclosure will be described with reference to the drawings.

An impeller has a plurality of blades disposed about a central axis of the impeller and extending radially. The impeller is rotatable about the central axis. Hereinafter, a direction about the central axis will be referred to as a "circumferential direction". When the impeller is viewed in plan view in a direction of the central axis, each blade is identical in shape, and an angle formed by line segments connecting positions corresponding to respective adjacent blades in the circumferential direction and a position of the central axis is defined as a pitch angle of the blades.

Figures 1, 2:
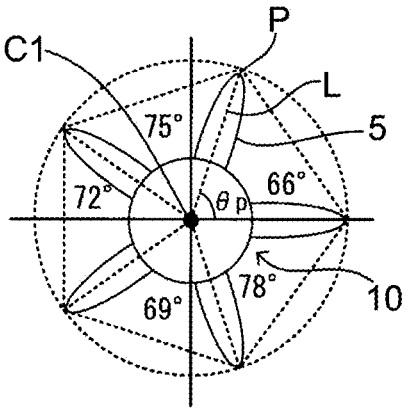
FIG. 1 is a plan view of an impeller according to an example embodiment of the present disclosure.
FIG. 2 is a diagram showing an example of pitch angle determination results by an exemplary determination method of the present disclosure when the number of blades is five.

For example, FIG. 1 is a diagram illustrating an example of an impeller having five blades when viewed in plan view in the direction of the central axis. FIG. 1 illustrates an impeller 10 in which each blade 5 is identical in shape, and an angle formed by line segments L connecting positions P corresponding to respective adjacent blades 5 in the circumferential direction and a position of a central axis C1 is defined as a pitch angle θp.

The present disclosure relates to an effective determination method of a pitch angle of blades in an impeller. Expressions (1) and (2) below are expressions for calculating a pitch angle, according to an example embodiment of the present disclosure.

[Expressions 1 and 2]

$$\text{Pitch}(n) = \frac{360}{Z} \cdot [1 + \Delta \cdot \text{SIGN}(n)] \quad (1)$$

$$\Delta = \%_A \cdot K(n) \quad (2)$$

In Expression (1), Z is the number of blades, n is a pitch number (an integer from 1 to Z), and the left side of Expression (1) indicates the n-th pitch angle. Z is an integer of 5 or more. That is, Expression (1) targets an impeller having five or more blades.

In Expression (1), Δ is a displacement ratio with respect to a pitch angle acquired by equally dividing a circumference) (360°) by the number of blades.

SIGN(n) is a polarity of the displacement ratio Δ and is also called an alternating code. SIGN(n) is represented by Expression (A) below and takes a value of 1 or −1.

$$\text{SIGN}(n) = \text{SIGN}e(n) \cdot \text{EVEN}(Z) + \text{SIGN}o(n) \cdot \text{ODD}(Z) \quad \text{Expression (A)}$$

$$\text{SIGN}e(n) = \cos\left(\pi \cdot \left(\text{ABS}\left(n - \frac{Z}{2} - 0.5\right) + 0.5\right)\right)$$

$$\text{SIGN}o(n) = \cos\left(\pi \cdot \left(n - \frac{Z}{2} - 0.5\right)\right)$$

$$\text{EVEN}(Z) = (1 - \text{mod}(Z, 2))$$

$$\text{ODD}(Z) = \text{mod}(Z, 2)$$

As shown in Expression (2), the displacement ratio Δ is represented by the product of an inequality ratio $\%_A$ and a relative weight K(n). The inequality ratio $\%_A$ is a ratio of a maximum amount of displacement to a pitch angle acquired by equally dividing a circumference by the number Z of blades. The relative weight K(n) has an absolute value of 1 (100%) or less.

The inequality ratio $\%_A$ is represented by Expression (3) below, and the relative weight K(n) is represented by Expression (4) below.

[Expressions 3 and 4]

$$\%_A = \frac{B \cdot Z(Z-1)}{A(1 + \text{mod}(Z, 2))} \quad (3)$$

$$K(n) = \frac{2 \cdot n - 1 - Z}{Z - 1} \quad (4)$$

In Expression (3), B (numerator)/A (denominator) is a positive irreducible fraction less than 1 and is a value set by a designer. Then, mod(x,y) is a remainder when x is divided by y. That is, mod(Z,2) is 1 when the number Z of blades is an odd number and 0 when it is an even number.

Here, the reason why Expression (3) holds is described. B/A is a minimum unit of an angle to be displaced from an equally divided pitch angle when an angle)(360° of a circumference of an impeller is set to 1 as a reference.

For example, when the number Z of blades is 5 (odd number) and B/A is 1/120, pitch angles are displaced in the circumferential direction in order by the following amount: −2/120, 1/120, 0, −1/120, and 2/120. The blades has an equally divided pitch angle of 360/Z that equals 72°, so that the pitch angles are as follows in the circumferential direction in order: 72°−(2/120)×360°=66°; 72°+(1/120)×360°=75°; 72°; 72°−(1/120)×360°=69°; and 72°+(2/120)×360°=78°. Thus, a maximum amount of displacement having the largest amount of displacement is acquired by multiplying a minimum unit of B/A that is 1/120 by (Z−1)/2 that is 2.

For example, when the number Z of blades is 6 (even number) and B/A is 1/120, pitch angles are displaced in the circumferential direction in order by the following amount: 5/120, −3/120, 1/120, −1/120, 3/120, and −5/120. The blades has an equally divided pitch angle of 360/Z that is 60°, so that the pitch angles are as follows in the circumferential direction in order: 60°+(5/120)×360°=75°; 60°−(3/120)×360°=51°; 60°+(1/120)×360°=63°; 60°−(1/120)×360°=57°; 60°+(3/120)×360°=69°; and 60°−(5/120)×360°=45°. Thus, a maximum amount of displacement having the largest amount of displacement is acquired by multiplying a minimum unit of B/A that is 1/120 by (Z−1) that is 5.

That is, when Z is an odd number, the maximum amount of displacement is acquired as follows: (B/A)×((Z−1)/2). When Z is an even number, the maximum amount of displacement is acquired as follows: (B/A)×(Z−1). Here, the inequality ratio $\%_A$ is a ratio of a maximum amount of displacement when the equally divided pitch angle is set to 1 as a reference. The pitch angle when equally divided is 1/Z. Thus, when Z is an odd number, (B/A)×((Z −1)/2) is divided by (1/Z) to acquire the inequality ratio $\%_A$ as follows: (B/A)×Z×(Z−1)/2, and when Z is an even number, (B/A)×(Z−1) is divided by (1/Z) to acquire the inequality ratio $\%_A$ as follows: (B/A)×Z×(Z−1). That is, the inequality ratio $\%_A$ is represented by Expression (3).

In the above example in which Z is 5, pitch angles are displaced in the circumferential direction in order by amounts acquired as follows: −1 times, 1/2 times, 0 times, −1/2 times, and 1 time a maximum amount of displacement that is 2/120. These multiples are each the product of the relative weight K(n) and the alternating code SIGN(n).

Here, FIG. 2 shows results of calculating pitch angles based on Expressions (1) to (4), and (A) when the number Z of blades is 5 and B/A is 1/120. FIG. 2 shows pitch numbers n, relative weights K(n), alternating codes SIGN (n), alternating relative weights that are each the product of K(n) and SIGN(n), alternating weights that are each the product of the inequality ratio $\%_A$ and the alternating relative weight, orders, and pitch angles. As shown in FIG. 2, the alternating relative weights that are each the product of K(n) and SIGN(n) is −100%(−1), 50%(1/2), 0%, −50%(−1/2), and 100%(1), in the order of the pitch numbers, and thus it can be seen that the alternating relative weights are the respective multiples described above.

FIG. 1 is a diagram illustrating an example of an impeller that reflects the pitch angle determination results shown in FIG. 2. As shown in FIG. 1, the pitch angle θp between the blades 5 adjacent to each other in the circumferential direction is set to corresponding one of values of the pitch angles shown in FIG. 2 in order in the circumferential direction.

Here, each of the orders appears as a denominator of an irreducible fraction of the value obtained by dividing the pitch angle by 360° for a circumference. For example, FIG. 2 shows that the pitch number n of 1 has a pitch angle of 66°, so that 66/360 equals 11/60, and thus the order is the 60th. The same applies to the pitch number n of 2 and higher, so that 75/360 equal to 5/24 for a pitch angle of 75° (n=2) defines the order as the 24th, 72/360 equal to 1/5 for a pitch angle of 72° (n =3) defines the order as the 5th, 69/360 equal to 23/120 for a pitch angle of 69° (n =4) defines the order as the 120th, and 78/360 equal to 13/60 for a pitch angle of 78° (n=5) defines the order as the 60th.

Figure 3:
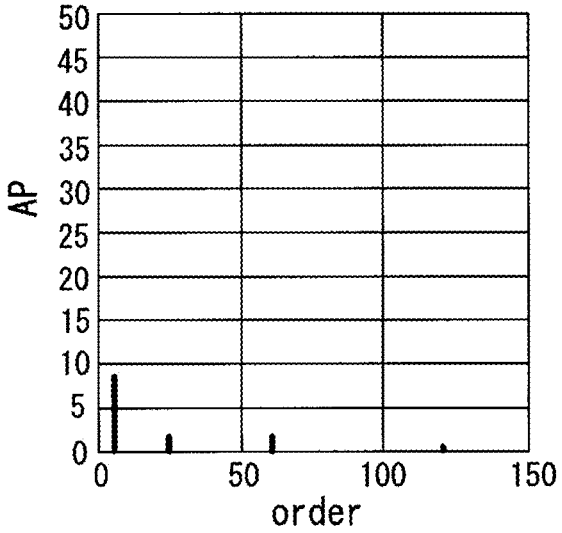
FIG. 3 is a diagram showing an example of a relationship between a sound pressure amplitude of wind noise generated by the impeller illustrated in FIG. 1 and an order.

FIG. 3 shows an example of a relationship between a sound pressure amplitude AP of wind noise generated by rotation of an impeller set to the pitch angles shown in FIG. 2 and the order. As the order increases, a frequency increases. As shown in FIG. 3, the peak of the sound pressure amplitude AP is reduced by dispersing the frequency of the wind noise. The sound pressure amplitude of the wind noise decreases as the frequency increases. There are two orders of the 60th as shown in FIG. 2, so that the sound pressure amplitude for the order of the 60th is twice a value when there is one order of the 60th in FIG. 3.

Figure 4:
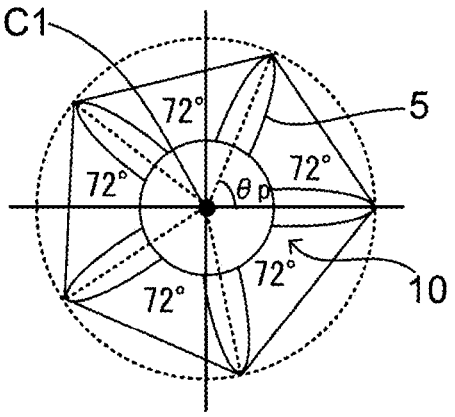
FIG. 4 is a plan view of an impeller including blades with pitch angles equally divided.
Figure 5:
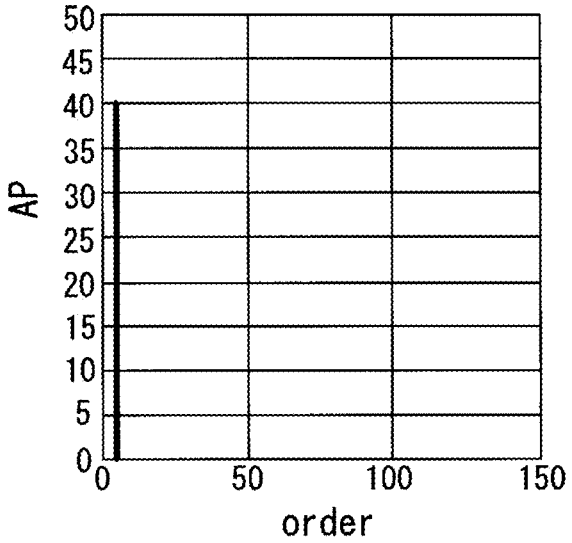
FIG. 5 is a diagram showing an example of a relationship between a sound pressure amplitude of wind noise generated by the impeller illustrated in FIG. 4 and an order.

In contrast, FIG. 4 is a plan view illustrating an example of an impeller when the number Z of blades is 5 and pitch angles are set equally, for example. FIG. 4 is a diagram corresponding to FIG. 1. As shown in FIG. 4, each pitch angle is 360/5 that equals 72°. In this case, the order is the fifth for all pitch angles. FIG. 5 shows an example of a relationship between the sound pressure amplitude AP of the wind noise and the order in this case. As shown in FIG. 5, the frequency of the wind noise is concentrated in a fifth-order component, and the sound pressure amplitude AP in the fifth-order increases. Comparing FIGS. 3 and 5, the peak of the sound pressure amplitude AP in FIG. 3 can be significantly reduced to about ⅕ of the peak thereof in FIG. 5.

The impeller having the pitch angles set by Expressions (1) to (4), and (A) has the following characteristics. The impeller has Z blades (Z is an integer of 5 or more) disposed in its circumferential direction and extending radially.

Pitch angles between the blades adjacent to each other are all different. For example, when Z is 5, the pitch angles shown in FIG. 2 are all different.

Figure 6:
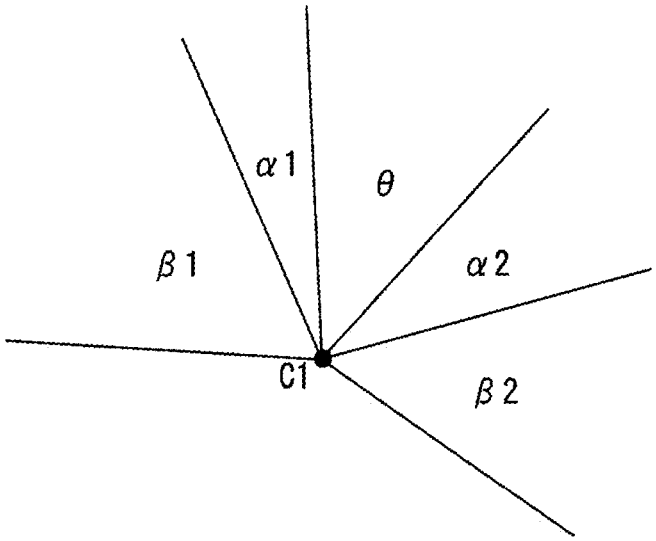
FIG. 6 is a diagram for illustrating a condition of pitch angles.

In terms of an arbitrary pitch angle θ as shown in FIG. 6, when a pitch angle α1 adjacent to the pitch angle θ, and a pitch angle α2 adjacent to the pitch angle θ, different from the pitch angle α1, satisfy a relation, α1<α2, a pitch angle β1 different from the pitch angle θ adjacent to the pitch angle α1 and a pitch angle β2 adjacent to the pitch angle α2, different from the pitch angle θ, satisfy a relation, β2<β1. For example, the pitch angles shown in FIG. 2 show that in terms of the pitch angle θ of 72° of the pitch number n of 3, the pitch angle α1 of 69° (n=4) and the pitch angle α2 of 75° (n=2) satisfy the relation, α1<α2, and the pitch angle β1 of 78° (n=5) and the pitch angle β32 of 66° (n=1) satisfy the relation, β2<β1. Even in terms of an arbitrary pitch angle θ of the pitch number n other than 3, similar conditions are satisfied.

The characteristics of the pitch angles as described above enable sound frequencies of the blades to disperse while maintaining centroid balance of the impeller. However, the present effect is more exerted when the impeller has blades that are all identical in mass.

Figure 7:
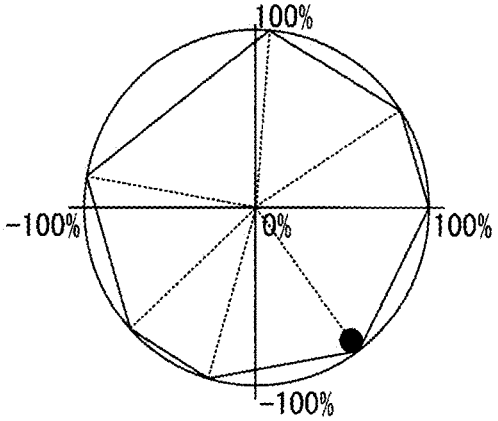
FIG. 7 is a diagram showing an example of pitch angle determination results and a centroid position by a conventional method when the number of blades is seven.

Here, FIG. 7 includes a table (left side) showing pitch angles in an example of uneven distribution of pitch angles by a method for attaching blades to respective positions based on a general golden angle, and an illustration (right side) showing pitch angles and a centroid position (black circle). FIG. 7 shows an example in which Z is 7. The pitch angles and the centroid position are illustrated while a radius of the impeller is assigned as 100%. When the centroid position is represented by a distance from the center of the impeller, the centroid position is ((55.8%) ^2+(−72.8%)^2) ^0.5 being 91.7%, as shown in FIG. 7, and thus is significantly displaced from the center.

Figure 8:
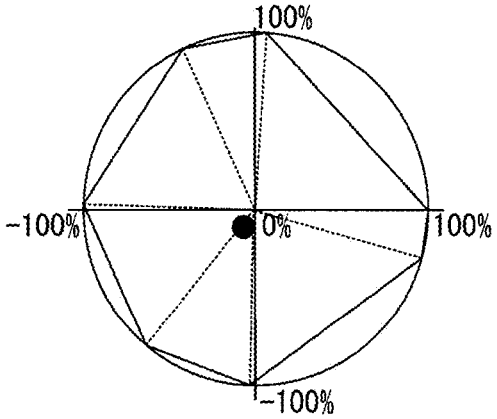
FIG. 8 is a diagram showing an example of pitch angle determination results and a centroid position by the exemplary determination method of the present disclosure when the number of blades is seven.

In contrast, FIG. 8 is a diagram for showing a result of determining pitch angles using Expressions (1) to (4) and a centroid position, when Z is 7 and B/A is 1/30 (inequality ratio $\%_A$ is 70%). The pitch angles shown in FIG. 8 satisfy the above conditions in terms of an arbitrary pitch angle θ. This allows the centroid position to be ((−7.3%)^2+(−9.2%) ^2)^0.5 equal to 11.8% as shown in FIG. 8. Although FIG. 8 shows a maximum pitch angle of 87.4° and a minimum pitch angle of 15.4°, having a large variation in pitch angle as in FIG. 7, it can be seen that displacement of the centroid position from the center can be significantly reduced as compared to that in FIG. 7.

When the number of blades is an odd number, the impeller has a first pitch angle that is greater than an angle acquired by dividing a circumference of the impeller by the number of blades, a second pitch angle smaller than the angle acquired by dividing the circumference of the impeller by the number of blades, and a third pitch angle equal to the angle acquired by dividing the circumference of the impeller by the number of blades, and the first pitch angle and the second pitch angle are alternately disposed in the circumferential direction with respect to the third pitch angle.

For example, when Z is 5 and the number of blades is an odd number as shown in FIG. 2, first pitch angles greater than the equally divided pitch angle of 72° are 75° and 78° , second pitch angles smaller than the equally divided pitch angle of 72° are 66° and 69°, and the third pitch angle is 72°, and then the first pitch angles and the second pitch angles are alternately arranged in the circumferential direction with reference to the third pitch angle.

This enables the centroid position to be brought closer to the center of the impeller when the number of blades is an odd number.

Figure 9:
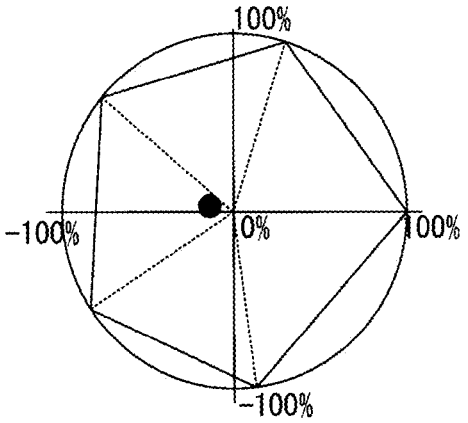
FIG. 9 is a diagram showing pitch angle determination results and a centroid position according to a comparative example when the number of blades is five.

Here, FIG. 9 shows a table of pitch angles set in an example in which the above conditions in terms of an arbitrary θ is satisfied, but the above conditions about the first to third pitch angles when the number of blades is an odd number are not satisfied, and an illustration of the pitch angles and a centroid position. FIG. 9 is an example in which Z is 5. FIG. 9 shows the centroid position that is 15.0%.

Figure 10:
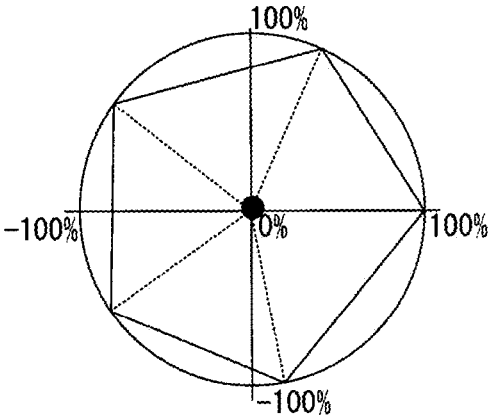
FIG. 10 is a diagram showing an example of pitch angle determination results and a centroid position by the exemplary determination method of the present disclosure when the number of blades is five.

In contrast, FIG. 10 is a diagram showing a determination result of pitch angles, and a centroid position, according to the example (Z is 5) shown in FIG. 2. As shown in FIG. 10, the centroid position is 2.01%, and it can be seen that displacement of the centroid position from the center position can be significantly reduced as compared to that in FIG. 9.

As another example in which the number of blades is an odd number, FIG. 11 shows a determination result of pitch angles when Z is 9. FIG. 11 shows calculation results when B/A is 1/72. The pitch angles shown in FIG. 11 also satisfy the above-mentioned conditions about the first to third pitch angles.

When the number of blades is an even number, the impeller has a first pitch angle that is greater than an angle acquired by dividing a circumference of the impeller by the number of blades, and a second pitch angle smaller than the angle acquired by dividing the circumference of the impeller by the number of blades, and the first pitch angle and the second pitch angle are alternately disposed in the circumferential direction.

Here, as an example in which the number of blades is an even number, FIG. 12 shows a determination result of pitch angles when Z is 8. FIG. 12 shows calculation results when B/A is 7/800. As shown in FIG. 12, first pitch angles greater than the equally divided pitch angle of 45° are 60.8°, 48.2°, 54.5°, and 67.1°, and second pitch angles smaller than the equally divided pitch angle of 45° are 23.0°, 35.6°, 41.9°, and 29.3° , and then the first pitch angles and the second pitch angles are alternately arranged in the circumferential direction.

Figure 13:
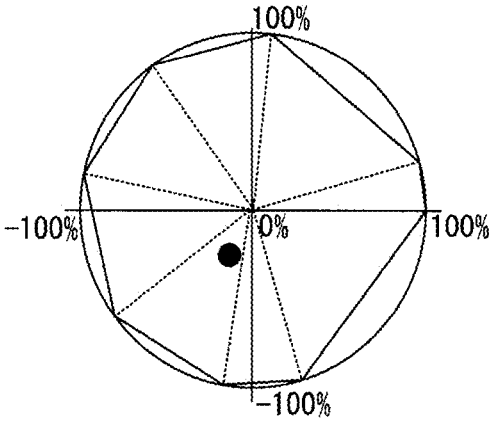
FIG. 13 is a diagram showing pitch angle determination results and a centroid position according to a comparative example when the number of blades is eight.

Here, FIG. 13 shows a table of pitch angles set in an example in which the above conditions in terms of an arbitrary 0 is satisfied, but the above conditions about the first and second pitch angles when the number of blades is an even number are not satisfied, and an illustration of the pitch angles and a centroid position. FIG. 13 is an example in which Z is 8. FIG. 13 shows the centroid position that is 27.6%.

Figure 14:
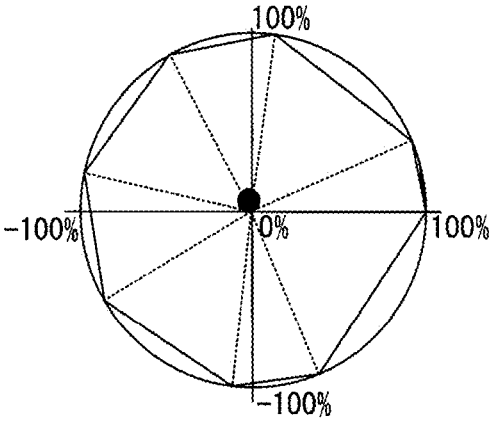
FIG. 14 is a diagram showing an example of pitch angle determination results and a centroid position by the exemplary determination method of the present disclosure when the number of blades is eight.

In contrast, FIG. 14 is a diagram showing a determination result of pitch angles, and a centroid position, according to the example (Z is 8) shown in FIG. 12. As shown in FIG. 14, the centroid position is 7.58%, and it can be seen that displacement of the centroid position from the center position can be significantly reduced as compared to that in FIG. 13.

This enables the centroid position to be brought closer to the center of the impeller when the number of blades is an even number.

Here, characteristics of Expressions described above for calculating a pitch angle will be described.

The n-th (n is an integer from 1 to Z) pitch angle satisfies Expression (1) above, and the displacement ratio Δ has an absolute value of 0 or an irreducible fraction less than 1. For example, FIG. 2 in the case where Z is 5 shows an alternating weight represented by Δ·SIGN(n), and absolute values of the displacement ratio Δ that are 1/12 (8.33%), 1/24 (4.17%), 0, 1/24 (4.17%), and 1/12 (8.33%) in order from n of 1, which are each 0 or an irreducible fraction less than 1.

As described above, when the pitch angle is represented by an irreducible fraction while a circumference is assigned as 1, the denominator of the irreducible fraction is indicated as an order. This facilitates specifying an order and controlling the order as compared with a case where the displacement ratio Δ is an irrational number or the like.

As represented in Expression (2), the displacement ratio A is represented by the product of the inequality ratio $\%_A$ and the relative weight K(n), and the inequality ratio $\%_A$ is a ratio of a maximum amount of displacement to a pitch angle acquired by equally dividing a circumference by the number Z of blades, and then the relative weight K(n) is a linear function of n, as represented in Expression (4) above.

This allows the displacement ratio Δ to have an integral multiple relationship with a reference value. For example, FIG. 7 shows a relationship in which the displacement ratio Δ is twice, three times, and four times the reference value of A of ±12.5%. The multiple of the displacement ratio Δ affects the denominator of the irreducible fraction, so that the order can be easily dispersed. Then, an algorithm is already fixed, so that setting a parameter allows a pitch angle to be uniquely determined. This enables a common design.

The inequality ratio $\%_A$ and the relative weight K(n) are represented by Expressions (3) and (4) above. Then, B/A is a positive irreducible fraction less than 1.

Here, when the pitch angle of a circumference in Expression (1) is represented as 1 and the right side of Expression (1) is divided by 360, and then ±is set to SIGN(n) for convenience, Expression (5) below is acquired.

$$\text{Pitch }(n)=1/Z\pm\%_A\cdot K(n)/Z \tag{5}$$

Here, when Expressions (3) and (4) are substituted into the second member on the right side of Expression (5) and are rearranged, Expression (6) below is acquired.

$$\%_A K(n)/Z=B/A/(1 \text{ or } 2)\cdot(2n-1-Z) \tag{6}$$

Then, for convenience, (1+mod(Z,2)) is represented as (1 or 2).

Here, when (2n−1−Z)/(1 or 2) is represented as η in Expression (6), Expression (7) is acquired.

$$\%_A\cdot K(n)/Z=\eta\cdot B/A \tag{7}$$

Thus, Expression (5) is substituted with Expression (8) below.

$$\text{Pitch }(n)=1/Z\pm\%_A\cdot K(n)/Z=1/Z\pm\eta B/A \tag{8}$$

The denominator of the irreducible fraction expressed by Expression (8) is indicated as an order. That is, a value of A that is the denominator of B/A allows a maximum order to be easily set. As the order decreases, the inequality ratio increases. Thus, a frequency is clearly dispersed, so that the effect of reducing a peak of sound is clarified. However, placement of blades is distorted accordingly, so that a centroid position is likely to be displaced. In contrast, increase of the order causes uneven distribution of pitch angles to be indistinguishable from even distribution, so that the effect of the uneven distribution decreases. Thus, the order is desirably set to a value that is neither too large nor too small.

For example, in the case where Z is 5 shown in FIG. 2, B/A is 1/120, so that orders are acquired according to Expression (8) as follows:

Pitch (1)=1/5−2/120=11/60 and thus the order is the 60-th;

Pitch (2)=1/5+1/120=5/24 and thus the order is the 24-th;

Pitch (3)=1/5+0/120=1/5 and thus the order is the 5-th;

Pitch (4)=1/5−1/120=23/120 and thus the order is the 120-th; and

Pitch (5)=1/5+2/120=13/60 and thus the order is the 60-th.

As a result, the maximum order is the 120-th.

The impeller described above can be applied to, for example, an axial fan, and a configuration example of the axial fan will be described below. The impeller is not limited to the axial fan, but can be applied to any blower such as a centrifugal fan.

Figure 15:
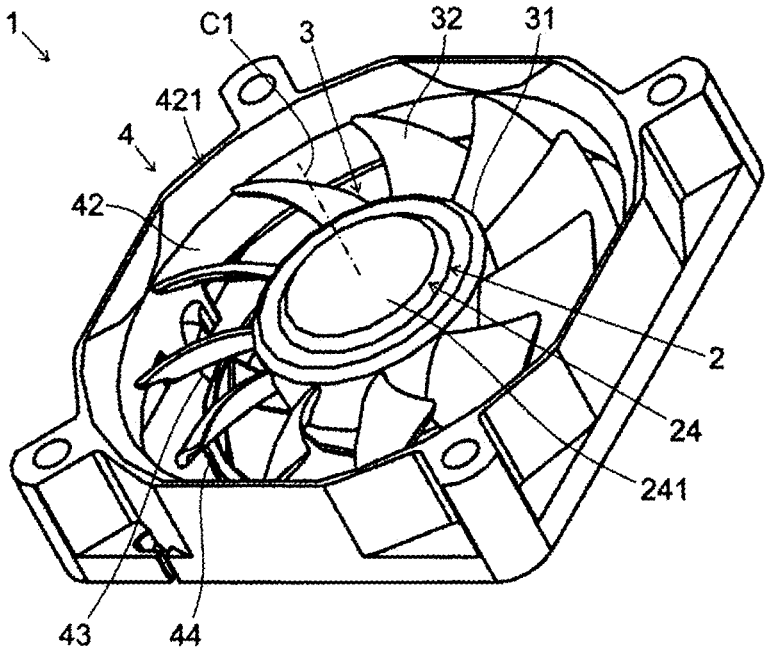
FIG. 15 is a perspective view of an axial fan according to an example embodiment of the present disclosure.
Figure 16:
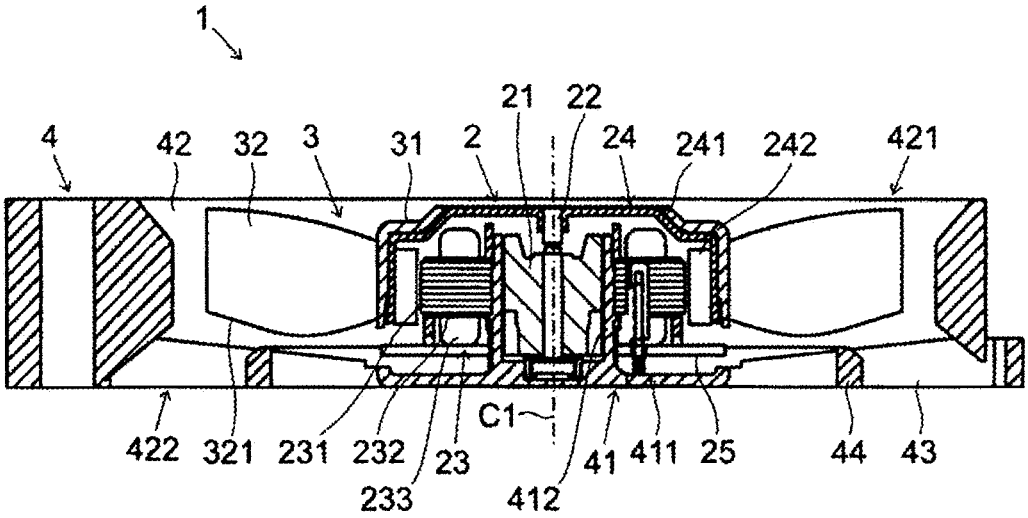
FIG. 16 is a longitudinal sectional view of an axial fan according to an example embodiment of the present disclosure.

FIG. 15 is a perspective view of an axial fan according to an example embodiment of the present disclosure as viewed from above. FIG. 16 is a longitudinal sectional view of an axial fan according to an example embodiment of the present disclosure.

An axial fan 1 includes a motor 2, an impeller 3, and a housing 4.

The motor 2 is disposed radially inside the housing 4. The motor 2 is supported by a motor base portion 41 of the housing 4. The motor 2 rotates the impeller 3 about the central axis C1 that vertically extends. The motor 2 includes a stator 23 and a rotor 24. More specifically, the motor 2 includes a bearing 21, a shaft 22, the stator 23, the rotor 24, and a circuit board 25.

The bearing 21 is held inside a bearing holding portion 412 in a cylindrical shape of the motor base portion 41. The bearing 21 is composed of a sleeve bearing. The bearing 21 may be composed of a pair of ball bearings disposed up and down.

The shaft 22 is disposed along the central axis C1. The shaft 22 is a columnar member that is made of metal such as stainless steel and that extends vertically. The shaft 22 is supported by the bearing 21 in a rotatable manner about the central axis C1.

The stator 23 is fixed to an outer peripheral surface of the bearing holding portion 412 of the motor base portion 41. The stator 23 includes a stator core 231, an insulator 232, and a coil 233.

The stator core 231 is formed by vertically layering electromagnetic steel plates such as silicon steel plates. The insulator 232 is formed of resin having insulating properties. The insulator 232 is provided surrounding an outer surface of the stator core 231. The coil 233 is composed of a conductor wire wound around the stator core 231 with the insulator 232 interposed therebetween.

The rotor 24 is disposed above and radially outside the stator 23. The rotor 24 rotates about the central axis C1 with respect to the stator 23. The rotor 24 includes a rotor yoke 241 and a magnet 242.

The rotor yoke 241 is a substantially cylindrical member that is made of a magnetic material and that has a lid on its upper side. The rotor yoke 241 is fixed to the shaft 22. The magnet 242 has a cylindrical shape and is fixed to an inner peripheral surface of the rotor yoke 241. The magnet 242 is disposed radially outside the stator 23. The magnet 242 has a magnetic pole surface on its inner periphery side with N poles and S poles that are alternately disposed in its circumferential direction.

The circuit board 25 is disposed below the stator 23. The circuit board 25 is electrically connected to a coil lead wire of the coil 233. The circuit board 25 is mounted with an electronic circuit for supplying drive current to the coil 233.

The impeller 3 is disposed radially inside the housing 4, and above and radially outside the motor 2. The impeller 3 is made of resin. The impeller 3 rotates about the central axis C1 extending vertically. The motor 2 rotates the impeller 3. That is, the impeller 3 is rotated about the central axis C1 by the motor 2. The impeller 3 includes an impeller cup 31 and a plurality of blades 32. Pitch angles between the corresponding blades 32 are set by the above-described determination method. That is, the axial fan 1 includes the impeller 3 according to the example embodiment of the present disclosure, and the motor that rotates the impeller 3. This enables vibration generated in the axial fan 1 to be reduced by maintaining centroid balance of the impeller 3.

The impeller cup 31 is fixed to the rotor 24. The impeller cup 31 is a substantially cylindrical member having a lid on its upper side. The rotor yoke 241 is fixed inside the impeller cup 31. The plurality of blades 32 is disposed on a radially outer surface of the impeller cup 31 in a circumferential direction thereof.

The housing 4 is disposed outside the motor 2 and the impeller 3. The housing 4 includes the motor base portion 41, a tubular portion 42, a first rib 43, and a second rib 44.

The motor base portion 41 is disposed below the motor 2. The motor base portion 41 includes a base portion 411 and the bearing holding portion 412. The base portion 411 is arranged below the stator 23 and has a disk shape that expands radially about the central axis C1. The bearing holding portion 412 projects upward from an upper surface of the base portion 411. The bearing holding portion 412 has a cylindrical shape about the central axis C1. The bearing 21 is housed and held inside the bearing holding portion 412. The stator 23 is fixed to a radially outer surface of the bearing holding portion 412. This allows the motor base portion 41 to support the stator 23.

The tubular portion 42 is disposed radially outside the impeller 3. The tubular portion 42 extends axially. The tubular portion 42 has a cylindrical shape. The tubular portion 42 is provided at its upper end with an intake port 421 that is a circular opening. The tubular portion 42 is provided at its lower end with an exhaust port 422 that is a circular opening.

The first rib 43 and the second rib 44 are disposed below the blades 32 and are adjacent to the exhaust port 422. The first rib 43 connects the motor base portion 41 and the tubular portion 42. The second rib 44 is connected to the first rib 43 and has an annular shape about the central axis C1.

The axial fan 1 configured as described above allows the stator core 231 to generate radial magnetic flux when drive current is supplied to the coil 233 of the stator 23. The magnetic flux of the stator 23 generates a magnetic field that interacts with a magnetic field generated by the magnet 242 to generate torque in a circumferential direction of the rotor 24. This torque causes the rotor 24 and the impeller 3 to rotate about the central axis C1. The impeller 3 rotates clockwise when the axial fan 1 is viewed from below. When the impeller 3 rotates, the plurality of blades 32 generates an air flow. That is, in the axial fan 1, an air flow with an upper side on an intake side and a lower side on an exhaust side is generated to perform blowing.

Although the example embodiments of the present disclosure are described above, the example embodiments can be modified in various ways within the scope of the present disclosure.

For example, SIGN(n) in Expression (61) above may be represented by Expression (B) below.

$$\mathrm{SIGN}(n) = \mathrm{SIGN}e(n)\cdot \mathrm{EVEN}(Z) + \mathrm{SIGN}o(n)\cdot \mathrm{ODD}(Z) \qquad \text{Expression (B)}$$

$$\mathrm{SIGN}e(n) = (-1)^{(ABS(n-\frac{Z}{2}-0.5)+0.5)}$$

$$\mathrm{SIGN}o(n) = -1\cdot(-1)^{n}$$

$$\mathrm{EVEN}(Z) = (1-\mathrm{mod}(Z,2))$$

$$\mathrm{ODD}(Z) = \mathrm{mod}(Z,2)$$

In FIG. 11 showing an example in which the number of blades is an odd number, when "a" is assigned to 12.5 of the alternating weight ($=\%_A\cdot K(n)\cdot SIGN(n)$) for generalization, the alternating weight changes in absolute value from a% to 2a%, 3a%, and 4a%, in order, and when a pitch tolerance is set to a/2%, the alternating weight changes in absolute value from a ±a/2% to 2a±a/2%, 3a±a/2%, and 4a±a/2%, in order.

In FIG. 12 showing an example in which the number of blades is an even number, when "a" is assigned to 7.00 of the alternating weight for generalization, the alternating weight changes in absolute value from a%, to 3a%, 5a%, and 7a%, in order, and when a pitch tolerance is set to a%, the alternating weight changes in absolute value from a ±a%, to 3a ±a%, 5a ±a%, and 7a±a%, in order.

The present disclosure can be used for various blowers, for example.

Features of the above-described example embodiments and the modifications thereof may be combined appropriately as long as no conflict arises.

While example embodiments of the present disclosure have been described above, it is to be understood that variations and modifications will be apparent to those skilled in the art without departing from the scope and spirit of the present disclosure. The scope of the present disclosure, therefore, is to be determined solely by the following claims.

What is claimed is:

1. An impeller comprising:

Z blades disposed in a circumferential direction of the impeller and extending radially, where Z is an integer equal to 5 or more; and pitch angles between the corresponding blades adjacent to each other being all different; wherein in terms of an arbitrary pitch angle θ, when a pitch angle α1 adjacent to the pitch angle θ, and a pitch angle α2 adjacent to the pitch angle θ, different from the pitch angle α1, satisfy a relation, α1<α2, a pitch angle ⊖1 different from the pitch angle θadjacent to the pitch angle α1 and a pitch angle β2 adjacent to the pitch angle α2, different from the pitch angle θ, satisfy a relation, β2<β1;

wherein an n-th pitch angle satisfies an expression below, where n is an integer from 1 to Z, and a displacement ratio A has an absolute value of 0 or an irreducible fraction less than 1;

$$\mathrm{Pitch}(n) = \frac{360}{Z} \cdot [1 + \Delta \cdot \mathrm{SIGN}(n)]$$

where Z is a number of the blades;

A is a displacement ratio; and

SIGN(n) is a polarity of the displacement ratio A and is represented by:

$$\mathrm{SIGN}(n) = \mathrm{SIGN}e(n) \cdot \mathrm{EVEN}(Z) + \mathrm{SIGN}o(n) \cdot \mathrm{ODD}(Z)$$

$$\mathrm{SIGN}e(n) = \cos\left(\pi \cdot \left(\mathrm{ABS}\left(n - \frac{Z}{2} - 0.5\right) + 0.5\right)\right)$$

-continued $$\mathrm{SIGN}o(n) = \cos\left(\pi \cdot \left(n - \frac{Z}{2} - 0.5\right)\right)$$

$$\mathrm{EVEN}(Z) = (1 - \mathrm{mod}(Z, 2))$$

$$\mathrm{ODD}(Z) = \mathrm{mod}(Z, 2).$$

2. The impeller according to claim 1, wherein the displacement ratio Δ is represented by a product of the inequality ratio $\%_A$ and the relative weight K(n);

the inequality ratio $\%_A$ is a ratio of a maximum amount of displacement to a pitch angle acquired by equally dividing a circumference by the number Z of blades; and the relative weight K(n) is a linear function of n.

3. The impeller according to claim 2, wherein the inequality ratio $\%_A$ and the relative weight K(n) are represented by:

$$\%_A = \frac{B \cdot Z(Z-1)}{A(1 + \mathrm{mod}(Z, 2))}$$

$$K(n) = \frac{2 \cdot n - 1 - Z}{Z - 1}$$

where B/A is a positive irreducible fraction less than 1.

4. An axial fan comprising:

the impeller according to claim 1; and a motor to rotate the impeller.

* * * * *